US005393632A

United States Patent [19]

Ciccarelli et al.

[11] Patent Number: 5,393,632

[45] Date of Patent: Feb. 28, 1995

[54] TONER COMPOSITIONS WITH MANGANESE COMPLEX CHARGE ENHANCING ADDITIVES

[75] Inventors: Roger N. Ciccarelli, Rochester; Thomas R. Pickering, Webster; Denise R. Bayley, Fairport; Jacques C. Bertrand, Ontario, all of N.Y.

[73] Assignee: Xerox Corporation, Stamford, Conn.

[21] Appl. No.: 113,117

[22] Filed: Aug. 30, 1993

[51] Int. Cl.[6] ..... G03G 9/097

[52] U.S. Cl. ..... 430/110; 430/106

[58] Field of Search ..... 430/106, 106.6, 110, 430/115

[56] References Cited

U.S. PATENT DOCUMENTS

| | | | |
|---|---|---|---|
| 4,206,064 | 6/1980 | Kiuchi et al. | 430/106 |
| 4,221,856 | 9/1980 | Lu | 430/110 |
| 4,298,672 | 11/1981 | Lu | 430/108 |
| 4,411,974 | 10/1925 | Lu et al. | 430/106 |
| 4,845,003 | 7/1989 | Kiriu et al. | 430/110 |
| 4,966,824 | 10/1990 | Niv | 430/115 |
| 5,300,387 | 4/1994 | Ong | 430/110 |
| 5,300,389 | 4/1994 | Law et al. | 430/110 |

*Primary Examiner*—John Goodrow
*Attorney, Agent, or Firm*—E. O. Palazzo

[57] ABSTRACT

A toner composition comprised of resin, pigment, and a manganese complex charge enhancing additive.

22 Claims, No Drawings

TONER COMPOSITIONS WITH MANGANESE COMPLEX CHARGE ENHANCING ADDITIVES

BACKGROUND OF THE INVENTION

This invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In embodiments, there are provided in accordance with the present invention toner compositions comprised of a polymer or polymer resins, pigment particles or dye molecules, and manganese complex charge enhancing additives obtained, for example, by the reaction of a manganese salt, such as manganese chloride or manganese sulfate, with an aikylsalicylic acid, and preferably di-tertiary-butylsalicylic acid. In embodiments, the present invention is directed to toners with manganese complexes of di-tertiary-alkyl, especially butylsalicylic acid charge enhancing additives. The aforementioned charge additives, in embodiments of the present invention enable, for example, toners with rapid admix, and stable triboelectric charging characteristics. Advantages associated with the charge additives of the present invention include their low cost, they are environmentally safe, minimal or no adverse impact on the melt index of certain toner resins like crosslinked SPAR TM polyesters, and the like. The aforementioned toner compositions usually contain a colorant component comprised of, for example, carbon black, magnetites, or mixtures thereof; color pigments or dyes such as cyan, magenta, yellow, blue, green, red, brown, or mixtures thereof thereby providing for the development and generation of black and/or colored images. The toner and developer compositions of the present invention can be selected for electrophotographic, especially xerographic, imaging and printing processes, including color processes, discharge area development (DAD), charged area development (CAD), hybrid scavengeless development, inductive magnetic brush, conductive magnetic brush, single component magnetic brush, and agitated zone development processes as illustrated in U.S. Pat. No. 4,368,970 (D/79176QI) or U.S. Pat. No. 4,394,429, the disclosures of which are totally incorporated herein by reference.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003, there are illustrated negatively charged toners with certain aluminum complex charge additives. More specifically, this patent discloses as charge additives aluminum complexes comprised of two or three hydroxybenzoic acid ligands bonded to a central aluminum ion. Disadvantages of some of these charge additives is their thermal instability, that is they often break down or decompose during the thermal extrusion process of the toner manufacturing cycle, and these additives can cause crosslinking in certain resins, thus toners with these additives can possess undesirable admix characteristics. Another disadvantage is that some of these additives are colored, which can render them unsuitable for use in nonblack toners, and also a number of these additives can be considered toxic in certain areas of the United States. A fast rate of triboelectric charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Many of these and other disadvantages are eliminated, or substantially eliminated with the metal complex charge additives of the present invention.

Developer compositions with charge enhancing additives, which impart a positive charge to the toner particles, are also known. Thus, for example, there is described in U.S. Pat. No. 3,893,935 the use of quaternary ammonium salts as charge control agents for electrostatic toner compositions; 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; similar teachings are presented in U.S. Pat. No. 4,291,112 wherein A is an anion including, for example, sulfate, sulfonate, nitrate, borate, chlorate, and the halogens; U.S. Pat. No. 4,338,390, the disclosure of which is totally incorporated herein by reference, illustrates developer compositions containing as charge enhancing additives organic sulfate and sulfonates, which additives can impart a positive charge to the toner composition; and U.S. Pat. No. 4,298,672, the disclosure of which is totally incorporated herein by reference, illustrates positively charged toner compositions with resins and pigment particles, and as charge enhancing additives alkyl pyridinium compounds.

Illustrated in U.S. Pat. No. 5,275,900 are toner compositions comprised of polymer resins, colorants comprised of color pigment particles or dye molecules, and certain metal complex charge additives derived from the reaction of a mixture of a hydroxybenzoic acid and a base with a metal ion in the presence of an excess of a hydroxyphenyl. More specifically, this copending application illustrates a negatively charged toner composition comprised of polymer, colorant, optional surface additives, and a metal complex charge enhancing additive of the following formula

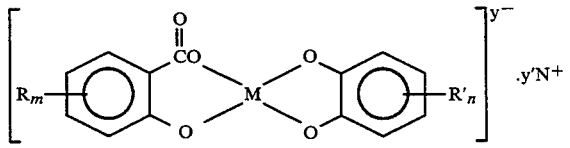

where M is a metal; N+ is a cation; R and R' are alkyl, alkoxy, aryloxy, halogen, carbonyl, amino, nitro, or mixtures thereof; m and n are the number of R substituents ranging from 0 to 3; y- is the magnitude of the negative charge of the anion; and y' represents the number of cations.

Illustrated in U.S. Pat. No. 5,309,387 is a negatively charged toner composition comprised of a polymer or polymers, pigment, and a metal complex charge enhancing additive as essentially represented by the following formula

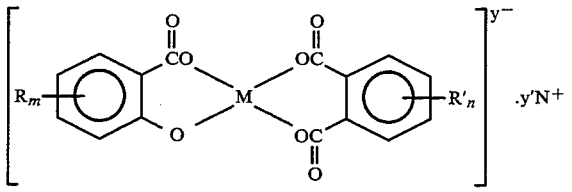

where M is the central metal ion; N+ is the countercation; R and R' are selected from the group consisting of alkyl, alkoxy, aryloxy, halogen, carbonyl group, alkoxycarbonyl group, amino group, nitro group or mixtures thereof; m and n are the number of R substituents on the aromatic rings, ranging from 0 to 3; y- is the magnitude of the negative charge of the anion or the number of the countercations of the metal complex, and represents the number 1 or 2; and y' represents the number of countercations N+; U.S. Ser. No. 964,544 (D/92402) discloses a toner composition comprised of a polymer or polymers, pigment particles and/or dyes, optional surface additives, and a charge enhancing additive of the following formula

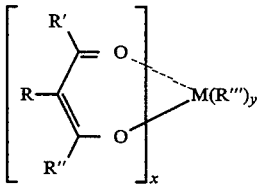

wherein R is hydrogen, alkyd, or aryl; R' and R'' are selected from the group consisting of alkyl, alkoxy, aryl, and aryloxy; R''' is selected from the group consisting of alkyl, alkoxy, oxide, and halide; M is boron or a metal; x is a number of from 1 to 4; and y is a number of from 0 to 2; and U.S. Pat. No. 5,290,651 discloses a negatively charged toner composition comprised of polymer, pigment, optional surface additives, and a zinc complex charge enhancing additive represented by either of the two following formulas

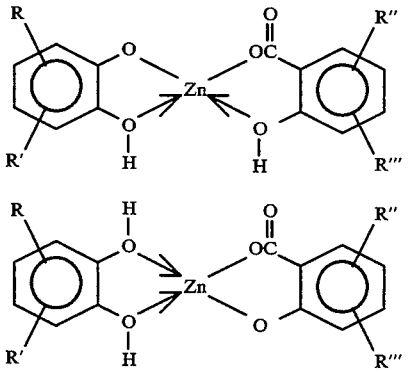

wherein R, R', R'', and R''' are independently selected from the group consisting of hydrogen, alkyl, aryl alkoxy, aryloxy, halogen, amino, and hydroxy. The disclosures of each of the aforementioned copending applications are totally incorporated herein by reference.

Illustrated in U.S. Pat. No. 5,250,381, the disclosure of which is totally incorporated herein by reference, is a negatively charged toner composition comprised of resin particles, pigment particles, and an aluminum salt of thiophenecarboxylic acid charge enhancing additive, and a negatively charged toner composition comprised of resin, pigment, and an aluminum salt charge enhancing additive of the following formula

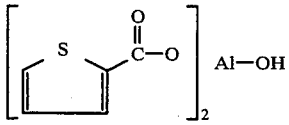

While a number of charge enhancing additives are known, there continues to be a need for charge enhancing additives which enable toners with many of the advantages illustrated herein. There is also a need for negative charge enhancing additives which are useful for incorporation into black and colored toner compositions which can be utilized for developing positively charged electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can, therefore, form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negatively charged toner compositions which have desirable triboelectric charge levels of, for example, from between about −10 to about −40 microcoulombs per gram, and preferably from about −15 to about −25 microcoulombs per gram, and triboelectric charging rates of less than about 120 seconds, and preferably from about 30 to about 60 seconds as measured by standard charge spectrograph methods or when the toners are frictionally charged against suitable carrier particles via conventional roll milling techniques. There is also a need for charge additives that are economical, and that are considered nontoxic. The amount of the charge additives that can be selected for the toner compositions of the present invention generally range from about 0.05 weight percent to about 10 weight percent, depending on whether the charge additive is utilized as a surface additive or as a dispersion in the bulk of the toner. The effective amount of toner in the developer, that is toner and carrier particles, is, for example, from about 0.5 to about 10 weight percent, and preferably from about 1 to about 5 weight percent.

SUMMARY OF THE INVENTION

It is an object of the present invention to provide toner and developer compositions with negative charge enhancing additives.

In another object of the present invention there are provided negatively charged toner compositions useful for the development of electrostatic latent images including color images.

A further object is to provide a simple and economical process for the preparation of manganese charge enhancing additives.

Another object is to provide a charge control additive that does not interact, or has minimal interaction with the resin during processing to the extent that it does not substantially effect the resin's mechanical properties as measured by melt index.

Also, in another object of the present invention there are provided toners with rapid admix charging characteristics, and wherein the toners contain environmentally safe charge additives and which additives do not contain components included on the EPA list, such as the California EPA list.

These and other objects of the present invention can be accomplished in embodiments thereof by providing toner compositions comprised of a polymer resin or polymer resins, colorants comprised of pigment particles or dyes, and certain charge additives. More specifically, the present invention in embodiments is directed to toner compositions comprised of resin, pigment particles, and a manganese complex negative charge enhancing additive of the formula

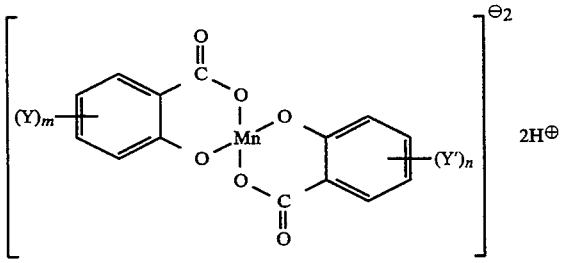

where Y and Y' are alkyl or alkoxy groups which can be the same or different; m and n are numbers such as 1 to 3 and also may be the same or different; and wherein alkyl and alkoxy contain, for example, from 1 to about 25, and preferably about 12 carbon atoms such as methyl, methoxy, ethyl, ethoxy, propyl, propoxy, butyl, butoxy, pentyl, pentoxy, hexyl, hexoxy, heptyl, heptoxy, octyl, octoxy, nonyl, nonoxy, and the like.

In embodiments, there is provided in accordance with the present invention a negatively charged toner composition comprised of resin, pigment, and a manganese complex charge enhancing additive of the following formula

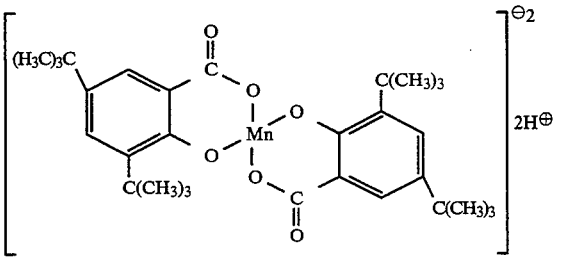

Examples of preferred charge additives include bis(3,5-di-tertiary-butyl salicto) manganese, bis(3,5-di-isopropyl salicto) manganese, and bis(3,5-methoxy salicto) manganese.

The aforementioned charge additives can be incorporated into the toner, may be present on the toner surface, or may be present on toner surface additives such as colloidal silica or certain metal oxides like $TiO_2$ particles. Advantages of rapid triboelectric charging characteristics of generally less than 120 seconds, and preferably less than 60 seconds, such as about 15 to about 30 seconds, in embodiments as measured by standard charge spectrograph methods or when the toners are frictionally charged against carrier particles by known conventional roll mixing methods, appropriate triboelectric charge levels, and the like can be achieved with many of the aforementioned toners of the present invention. In another embodiment of the present invention, there are provided, subsequent to known micronization and classification, toner particles with an average volume diameter of from about 5 to about 20 microns.

The manganese charge additives of the present invention can be prepared by the reaction of substituted salicylic acid, wherein the substitution is an alkyl such as propyl, isopropyl, butyl, isobutyl, tertiary butyl, pentyl and the like or an alkoxy such as methoxy, ethoxy, propoxy, butoxy, pentoxy, heptoxy, octoxy, and the like, dissolved in water with a known base such as sodium hydroxy, and with an aqueous manganese salt solution such as manganese chloride or manganese sulfate. The ratio of the reactants is, for example, such that there are 2 molecules of acid for every molecule of manganese. The reaction can be accomplished at temperatures ranging from about room temperature to 95° C. The resulting precipitate is filtered and washed with clean water and dried. The product can be identified by various known means such as by Infrared analysis.

The toner compositions of the present invention can be prepared by a number of known methods such as admixing and heating polymer resins such as styrene butadiene copolymers, colorants such as color pigment particles or dye compounds, and the aforementioned manganese charge enhancing additive, or mixtures of charge additives in a concentration preferably ranging from about 0.5 percent to about 5 percent in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with an average volume diameter of from about 5 to about 25 microns, and preferably from about 5 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; polyurethanes; polyamides and polyimides; polyesters; mixtures thereof, and the like. The polymer resins selected for the toner compositions of the present invention can include homopolymers or copolymers of two or more monomers. Furthermore, the above mentioned polymer resins may also be crosslinked depending on the desired toner properties. Illustrative vinyl monomer components include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of diols in the polyester resins include ethanediol, propanediols, butanediols, pentanediols, pinacol, cyclopentanediols, hydrobenzoin, bis(hydroxyphenyl)alkanes, dihydroxybiphenyl, substituted dihydroxybiphenyls, and the like.

As one toner resin, there can be selected polyester resins derived from a dicarboxylic acid and a diphenol. These resins are illustrated in U.S. Pat. No. 3,590,000, the disclosure of which is totally incorporated herein by reference, polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Ser. No. 814,641 (D/91117) and U.S. Pat. No. 5,227,460 (D/91117Q), the disclosures of which are totally incorporated herein by reference, can be selected as toner resins. Specific toner resins include styrene methacrylate copolymers, styrene acrylate copolymers, and styrene butadiene copolymers; PLIOLITES ®; and suspension polymerized styrene butadienes, reference U.S. Pat. No. 4,558,108, the disclosure of which is totally incorporated herein by reference. Also, waxes with a molecular weight Mw of from about 1,000 to about 20,000 and preferably to about 7,000, such as polyethylene, polypropylene, and paraffin waxes can be included in, or on the toner compositions as fuser roll release agents.

The polymer resins are present in a sufficient, but effective amount, for example from about 30 to about 98 and preferably from about 70 to about 95 weight percent. Thus, when 1 percent by weight of the charge enhancing additive is present, and 11 percent by weight of colorant, such as carbon black or color pigment, is contained therein, about 88 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent in embodiments.

Numerous well known suitable color pigments or dyes can be selected as the colorant for the toner compositions including, for example, carbon black like REGAL 330®, VULCAN™ carbon black, other carbon blacks available from Cabot Corporation, nigrosine dye, metal phthalocyanines, aniline blue, magnetite, or mixtures thereof. The colorant, which in embodiments is preferably carbon black or other color pigments, should be present in a sufficient amount to render the toner composition with a sufficiently high color intensity. Generally, the colorants are present in amounts of from about 0.1 weight percent to about 20 weight percent, and preferably from about 1 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK ®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK ®, in an amount of, for example, from about 5 to about 70, and preferably from about 10 to about 55 weight percent can be selected for black toner compositions of the present invention.

There can also be blended with the toner compositions of the present invention external additives including flow aid additives, which additives are usually present on the surface thereof. Examples of these additives include colloidal silicas, such as AEROSIL ®, metal oxides like aluminum oxides, and $TiO_2$, metal salts and metal salts of fatty acids inclusive of zinc stearate, cerium oxides, titanium oxides, and mixtures thereof, which additives are generally present in an amount of from about 0.1 percent by weight to about 5 percent by weight, and preferably of from about 0.5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL ®, can be surface treated with the metal charge additives of the present invention illustrated herein in an amount of from about 1 to about 50 weight percent and preferably 10 weight percent to about 25 weight percent, followed by the addition thereof to the toners in an amount of from about 0.1 to about 10 and preferably 0.1 to 5 weight percent.

Also, there can be included with the toner compositions of the present invention low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Developer compositions of the present invention can be comprised of toner resins, carrier particles, the charge enhancing additives illustrated herein, and as colorants black, red, blue, green, brown, magenta, cyan and/or yellow dyes, and mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as colorants include copper phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In embodiments, these colorants are present in the toner composition in an amount of from about 1 percent by weight to about 15 and preferably about 5 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention that are selected would render the toner particles negatively charged while acquiring a positive charge polarity themselves via frictional charging against the toner particles. The opposite charge polarities of the carrier and toner particles of the developer composition ensure that the toner particles adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; silicone resins known for this purpose; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. No. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from between about 60 and about 200 microns in volume average diameter thereby permitting them, for example, to possess sufficient density and inertia to avoid adherence to the electrostatic images during the development process. The carrier component can be mixed with the toner composition,on in various suitable combinations, such as about 1 to 7 parts of toner to about 100 parts to about 200 parts by weight of carrier.

The toner composition of the present invention can be prepared by a number of known methods as indicated herein, including extrusion melt blending the toner resins, colorants, and the manganese charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and optional surface additives. Further, other methods of preparation for the toner are as illustrated herein.

The toner and developer compositions of the present invention may be selected for use in electrostatographic imaging and printing apparatuses containing therein conventional photoreceptors providing that they are capable of, for example, forming positive electrostatic latent images relative to the triboelectric charge polarity of the toners.

The toners of the present invention are usually jetted and classified subsequent to preparation to enable toner particles with a preferred average volume diameter of from about 5 to about 25 microns, and more preferably from about 5 to about 12 microns. The triboelectric charging rates for the toners of the present invention are preferably less than 120 seconds, and more specifically, less than 60 seconds in embodiments thereof as determined by the known charge spectrograph method as described hereinbefore. Toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

The following Examples are being submitted to further illustrate various embodiments of the present invention, it being noted that these Examples are intended to illustrate and not limit the scope of the present invention. Comparative information is also presented.

EXAMPLE I

Synthesis of the Manganese Complex of Di-tertiary-butylsalicylic Acid:

To a first solution of 40 grams (1 mole) of NaOH in 2,500 milliliters of water were added 250.37 grams (1 mole) of 3,5-di-t-butylsalicylic acid. The resulting mixture was heated to about 85° C. to assist in dissolving the acid. A second solution was prepared by dissolving 62.92 grams (0.5 moles) of manganese chloride in 700 milliliters of warm tap water. The manganese chloride solution was added dropwise (fast drip) with stirring to the above prepared heated first solution containing the sodium salt of the acid. About ⅔ of the way through the addition, more water can be added to the reaction solution to maintain thorough mixing of the thickening mixture. When the addition was completed, the reaction mixture was stirred an additional 10 to 20 minutes at 85° C. and then cooled to room temperature, about 25° C. The mixture was then filtered and the collected solid product was washed with water until the acidity of the used wash water was about 5.5. The product was dried in a vacuum oven at 120° F. to a constant weight to afford 268.87 grams (0.485 moles, 97.1 percent of theory) of a grayish-white powder. When a sample of the product obtained was analyzed for water by Karl-Fischer titration after drying for an additional 12 hours at 100° C. in a vacuum, the sample contained 2.76 weight percent of water. The theoretical value calculated for one mole of water with the product is 3.25 weight percent of water.

Infrared spectra of the above product indicated the presence of a manganese carboxylate (Mn—COO—) bond not present in the starting acid and an absence of the carboxylic acid peaks in the 2,400 $cm^{-1}$ to 2,700 $cm^{-1}$ region characteristic of the starting material, 3,5-di-t-butylsalicylic acid.

Elemental Analysis for $C_{30}H_{42}O_6Mn$: Calculated: C, 65.08; H, 7.66; Mn, 9.92. Found: C, 62.95; H, 7.88; Mn, 9.55.

EXAMPLE IA

Synthesis of the Manganese Complex of Di-isopropylsalicylic Acid:

To a first solution of 1.8 grams (0.045 mole) of NaOH in 100 milliliters of water were added 10 grams (0.045 mole) of di-isopropylsalicylic acid. The resulting mixture was heated to about 85° C. to help dissolve the acid. A second solution was prepared by dissolving 3.80 grams (0.0224 mole) of manganese sulfate monohydrate in 20 milliliters of warm tap water. The manganese sulfate solution was added dropwise (fast drip) with stirring to the heated first solution containing the sodium salt of the acid. When the addition was completed, the reaction mixture was stirred an additional 10 to 20 minutes at 85° C. and then cooled to room temperature, about 25° C. The mixture was then filtered and the collected solid product was washed with water until the acidity of the used wash water was about 5.5. The product was dried in a vacuum oven at 120° F. to a constant weight to afford 7.86 grams (0.016 mole, 70 percent of theory) of a grayish-white powder product.

EXAMPLE IB

Synthesis of the Manqanese Complex of Methoxysalicylic Acid:

To a first solution of 1.19 grams (0.03 mole) of NaOH in 50 milliliters of water were added 5 grams (0.03 mole) of 5-methoxysalicylic acid. The resulting mixture was heated to about 85° C. to help dissolve the acid. A second solution was prepared by dissolving 2.51 grams (0.015 moles) of manganese sulfate monohydrate in 25 milliliters of warm tap water. The manganese sulfate solution was added dropwise (fast drip) with stirring to the heated first solution containing the sodium salt of the acid. No precipitate was formed. When the addition was completed, the reaction mixture was stirred an additional 10 to 20 minutes at 85° C. and then cooled to room temperature, about 25° C. The reaction mixture was then dripped into 3 times the volume of methanol (about 225 milliliters), at which time a precipitate was formed. This solid product was collected, and washed with methanol. The product, manganese complex of methoxysalicylic acid, was dried in a vacuum oven at 120° F. to a constant weight to afford 2.01 grams (0.005 mole; 34 percent of theory) of an off white powder product.

EXAMPLE II

There was prepared in an extrusion device, available as ZSK-28 from Werner Pfleiderer, a toner composition comprised of 98.0 parts of a crosslinked polyester comprised of a 50/50 mixture of fumaric acid and propoxylated bisphenol A polyester and 2.0 parts of PV FAST BLUE TM pigment obtained from Hoechst Celanese by melt blending these components in the extruder followed by micronization and air classification to yield toner sized particles of 10 microns in average volume diameter as determined by a Coulter Counter. A developer was prepared by selecting 3 parts of the toner and blending it with 100 parts of Hoeganoes Anchor Steel core with a particle diameter range of from about 75 to about 150 microns, available from Hoeganoes Company, which was solution coated with 1 part by weight of a coating comprising 20 parts by weight of VULCAN TM carbon black, available from Cabot Corporation, homogeneously dispersed in 80 parts by weight of polymethylmethacrylate, which coating was solution coated from toluene, and roll milling for a period of about 30 minutes which resulted in a developer with a toner exhibiting a triboelectric charge of −8.6 microcoulombs per gram as determined by the known Faraday Cage method. A charge spectrograph analysis of the developer measured at 125 volts/centimeter resulted in a bimodal charge distribution through 60 seconds indicating that this developer without charge control additive admixed in greater than 1 minute.

EXAMPLE III

A toner was prepared as follows: 95.0 parts of a crosslinked polyester consisting of a 50/50 mixture of fumaric acid and propoxylated bisphenol A polyester, 2.0 parts of PV FAST BLUE TM pigment from Hoechst Celanese, and 3 parts of the manganese complex compound of Example I were melt blended in an extruder followed by micronization and air classification to yield toner sized particles of 10 microns in average volume diameter. A developer was prepared by mixing 3 parts of the toner and blending it with 100 parts of the coated carrier described in Example II and roll milling for a period of about 30 minutes which resulted in a developer with a toner exhibiting a triboelectric charge of −14.2 microcoulombs per gram. A charge spectrograph analysis of the developer measured at 125 volts/centimeter resulted in a 15 second admix, evidencing a significant improvement in admix performance over the same toner with no charge control additive.

EXAMPLE IVA

A toner was prepared with, it is believed, excellent admix by repeating the process described in Example II except that 97 parts of a crosslinked polyester comprised of a 50/50 mixture of fumaric acid and propoxylated bisphenol A, and 3 parts of a prior art charge additive, the hydroxy aluminum compound available as BONTRON E-88 TM from Orient Chemicals, was used. The melt flow properties of this toner were measured using a melt index apparatus at a temperature of 117° C. with a 2.16 killigram weight resulting in a M.I. of 3.46. The extruded resin without the aluminum compound BONTRON E-88 TM resulted in a M.I. of 19.55 when measured under the same conditions.

EXAMPLE IVB

A toner was prepared by repeating the process described in Example II except that 97 parts of a crosslinked polyester comprised of a 50/50 mixture of fumaric acid and propoxylated bisphenol A, and 3 parts of the hydroxy bis[3,5-tertiary butyl salicylic] aluminate, reference U.S. Pat. No. 5,223,368 (D/90404), the disclosure of which is totally incorporated herein by reference, was used. The melt flow properties of this toner were measured using a melt index apparatus at a temperature of 117° C. with a 2.16 killigram weight resulting in a M.I. of less than 1.

EXAMPLE V

The melt flow properties of the toner from Example III were measured using a melt index apparatus at a temperature of 117° C. with a 2.16 killigram weight resulting in a M.I. of 15.64 which is indicative that the melt rheology of the resin did not change due to the presence of the manganese compound as it did with the BONTRON E-88 TM and the hydroxy bis[3,5-tertiary butyl salicylic] aluminate, reference U.S. Pat. No. 5,223,368 (D/90404). As a further comparison, the melt flow properties of the control toner from Example II were measured under the same conditions resulting in a M.I. of 16.06.

EXAMPLE VI

The toner of Example II was surface blended with 0.2 part of the manganese compound prepared in Example I by shaking for 10 minutes at 606 revolutions per minute using a Red Devil 5410 paint shaker. A developer with this toner was prepared with the coated carrier as in Example II resulting in a toner triboelectric charge of −17.71 microcoulombs pergram.

EXAMPLE VII

The toner of Example II was surface blended with 0.2 part of the manganese compound prepared in Example IA by shaking for 10 minutes at 606 revolutions per minute using a Red Devil 5410 paint shaker. A developer with this toner was prepared with the coated carrier as in Example II resulting in a toner triboelectric charge of −13.31 microcoulombs per gram.

Other modifications of the present invention may occur to those skilled in the art subsequent to a review of the present application. The aforementioned modifications, including equivalents thereof, are intended to be included within the scope of the present invention.

What is claimed is:

1. A negatively charged toner composition comprised of resin, pigment, and a manganese complex charge enhancing additive of the following formula

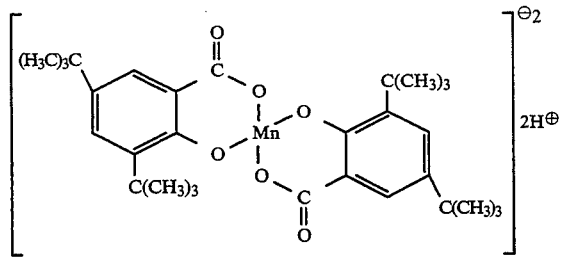

2. A toner composition in accordance with claim 1 wherein the charge enhancing additive is present in an amount of from about 0.05 to about 5 weight percent.

3. A toner composition in accordance with claim 1 wherein the charge enhancing additive is present in an amount of from about 0.1 to about 3 weight percent.

4. A toner composition in accordance with claim 1 wherein the charge enhancing additive is incorporated into the toner, or is present on the surface of the toner composition.

5. A toner composition in accordance with claim 4 wherein the charge enhancing additive is contained on colloidal silica particles.

6. A toner composition in accordance with claim 1 wherein the charge additive is the manganese complex of di-tertiary-butylsalicylic acid.

7. A toner composition in accordance with claim 1 wherein the toner's rate of charging is from about 15 seconds to about 60 seconds.

8. A toner composition in accordance with claim 1 with a negative triboelectric charge of from between about −10 to about −40 microcoulombs per gram.

9. A toner composition in accordance with claim 1 wherein the resin is comprised of styrene polymers, acrylic polymers, methacrylic polymers, polyesters, or mixtures thereof.

10. A toner composition in accordance with claim 1 wherein the resin is comprised of styrene acrylates, styrene methacrylates, styrene butadienes, linear polyesters or crosslinked polyesters.

11. A toner composition in accordance with claims 1 containing a wax component which has a weight average molecular weight of from about 1,000 to about 20,000.

12. A toner composition in accordance with claim 11 wherein the wax component is selected from the group consisting of polyethylene and polypropylene.

13. A toner composition in accordance with claim 1 wherein the toner further includes surface additives of metal salts of a fatty acid, colloidal silicas, titanium dioxide, aluminum oxide, or mixtures thereof.

14. A toner composition in accordance with claim 1 wherein the pigment is carbon black, magnetites, or mixtures thereof, cyan, magenta, yellow, red, blue, green, brown pigments or dyes, and mixtures thereof.

15. A developer composition comprised of the toner composition of claim 1 and carrier particles.

16. A developer composition in accordance with claim 15 wherein the carrier particles are comprised of ferrites, steel, or an iron powder with a polymer, or mixtures of polymers coating thereover.

17. A toner composition in accordance with claim 1 further containing metal oxides.

18. A toner composition in accordance with claim 1 which possess constant melt index characteristics.

19. A negatively charged toner composition comprised of resin, pigment, and a manganese complex charge enhancing additive of the formula

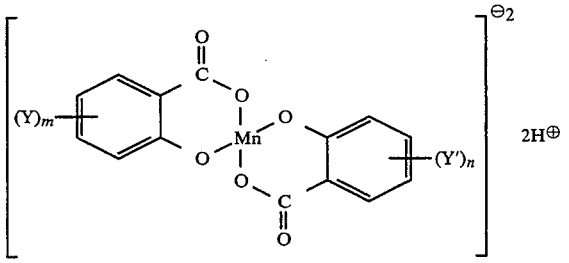

where Y and Y' are independently alkyl or alkoxy; and m and n are numbers of 1 to 3.

20. A negatively charged toner in accordance with claim 19 wherein alkoxy contains from 1 to about 25 carbon atoms.

21. A negatively charged toner composition comprised of resin, pigment, and a manganese complex charge enhancing additive of the following formula

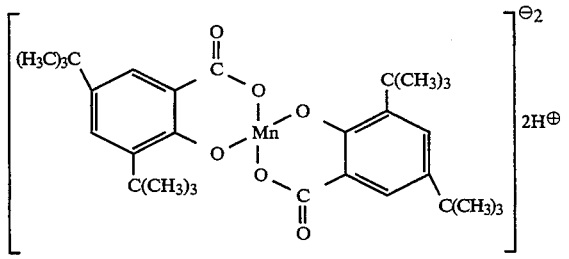

22. A negatively charged toner in accordance with claim 21 wherein said manganese complex charge enhancing additive is bis(3,5-di-tertiary-butyl salicto) manganese, bis(3,5-di-isopropyl salicto) manganese, or bis (3,5-methoxy salicto) manganese.

* * * * *